US006715326B2

(12) United States Patent
Price

(10) Patent No.: US 6,715,326 B2
(45) Date of Patent: Apr. 6, 2004

(54) DUAL CHAMBER APPARATUS USEFUL AS SPOT REMOVER AND MANUFACTURING PROCESS THEREFOR

(75) Inventor: Jeffrey L. Price, Palm Beach Gardens, FL (US)

(73) Assignee: Vital Pharma, Inc.

( * ) Notice: Subject to any disclaimer, the term of this patent is extended or adjusted under 35 U.S.C. 154(b) by 161 days.

(21) Appl. No.: 10/061,793

(22) Filed: Feb. 1, 2002

(65) Prior Publication Data

US 2003/0145634 A1 Aug. 7, 2003

(51) Int. Cl.[7] ..... D06F 39/00
(52) U.S. Cl. ..... 68/213; 68/214; 68/220
(58) Field of Search ..... 8/148; 68/5 A, 68/5 B, 63, 92, 213, 214, 220; 222/187; 401/183, 139, 132, 196; 132/317, 318

(56) References Cited

U.S. PATENT DOCUMENTS 1,878,475 A * 9/1932 Driest
2,666,555 A * 1/1954 Hill
2,807,818 A * 10/1957 Taylor
3,209,769 A * 10/1965 Gobin
3,356,095 A * 12/1967 Tylle
3,682,558 A * 8/1972 Miller
4,053,243 A * 10/1977 Levin
4,289,153 A * 9/1981 Paccione
4,652,163 A * 3/1987 Karliner et al.
4,723,860 A * 2/1988 Giblin et al.
4,966,483 A * 10/1990 Hashimoto et al.
4,998,545 A * 3/1991 Hiromura
5,098,297 A * 3/1992 Chari et al.
5,122,158 A * 6/1992 Kuroda et al.
5,490,736 A * 2/1996 Haber et al.
5,509,742 A * 4/1996 Balzarini
5,555,673 A * 9/1996 Smith
5,746,531 A * 5/1998 Izhak
5,765,407 A * 6/1998 Choo et al.
5,899,624 A * 5/1999 Thompson
5,927,884 A * 7/1999 Kao
5,971,645 A * 10/1999 Fukushima et al.
6,145,513 A * 11/2000 Chu et al.
6,213,129 B1 * 4/2001 Muldoon
6,233,771 B1 * 5/2001 Hortel et al.
RE37,675 E * 4/2002 Gueret
6,482,242 B2 * 11/2002 Yarmosky

FOREIGN PATENT DOCUMENTS

DE 198 11 552 * 9/1999

* cited by examiner

*Primary Examiner*—Frankie L. Stinson
(74) *Attorney, Agent, or Firm*—R. Gale Rhodes, Jr.

(57) ABSTRACT

Dual chamber apparatus including a body providing a first chamber containing liquid, a closure closing the first chamber and a second chamber containing a body of material including a portion extending out of the second chamber, upon the closure being removed and the liquid being discharged from the first chamber the body of material for engaging and reacting with the liquid. The apparatus may be embodied as spot remover apparatus with the liquid being liquid spot remover and with the body of material being absorbent material for absorbing the liquid spot remover upon being discharged and removing a spot. Process of manufacturing such apparatus.

4 Claims, 6 Drawing Sheets

DUAL CHAMBER APPARATUS USEFUL AS SPOT REMOVER AND MANUFACTURING PROCESS THEREFOR

BACKGROUND OF THE INTENTION

This invention relates generally to dual chamber apparatus and to a process for manufacturing such apparatus, and more particularly, relates to dual chamber spot remover apparatus and to a process for manufacturing such apparatus.

By way of example, and not by sway of limitation, there is a need in the art for spot remover apparatus for removing spots of salad oil, soup, ketchup, mustard and the like, from dresses, blouses, shirts, ties, jackets, and the like, and which spot remover apparatus is of a size and shape that permits it to be conveniently kept in a lady's purse, a man's pocket or a desk drawer for ready use away from home.

SUMMARY OF THE INVENTION

Dual chamber apparatus including a body providing a first chamber containing liquid, a closure closing the first chamber and a second chamber containing a body of material including a portion extending out of the second chamber, upon the closure being removed and the liquid being discharged from the first chamber the body of material is for engaging and reacting with the liquid. The apparatus may be embodied as spot remover apparatus with the liquid being liquid spot remover and with the body of material being absorbent material for absorbing the liquid spot remover upon being discharged and dissolving a spot. Process of manufacturing such apparatus.

DESCRIPTION OF THE PREFERRED EMBODIMENT

Figure 1:
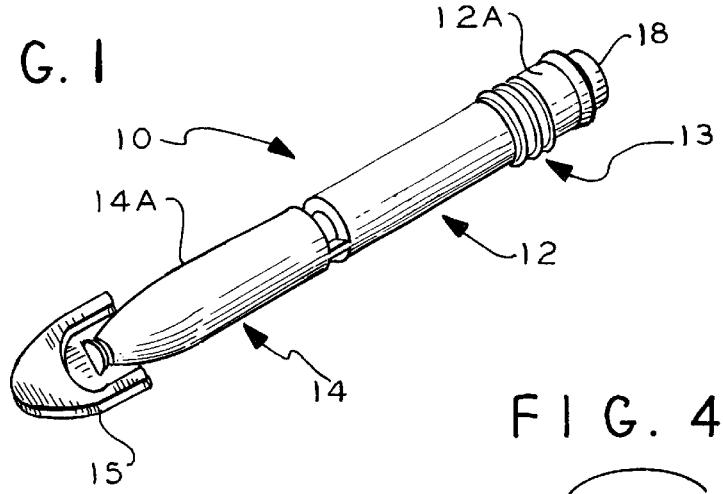
FIG. 1 is a perspective view of spot apparatus embodying the present dual chamber apparatus invention.
Figure 2:
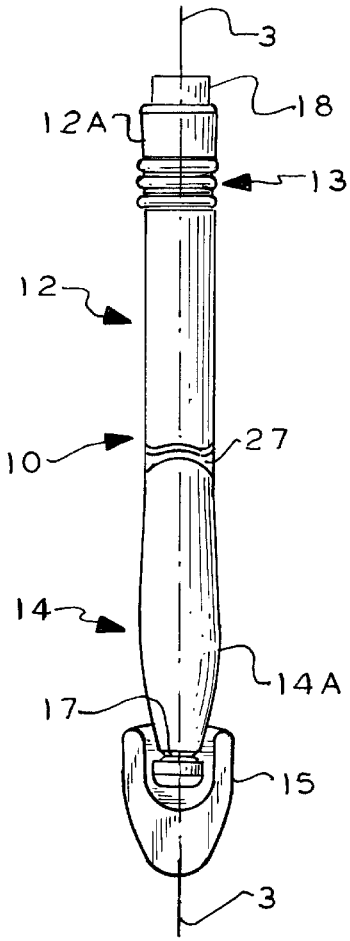
FIG. 2 is an elevational view of the apparatus of FIG. 1.
Figure 3:
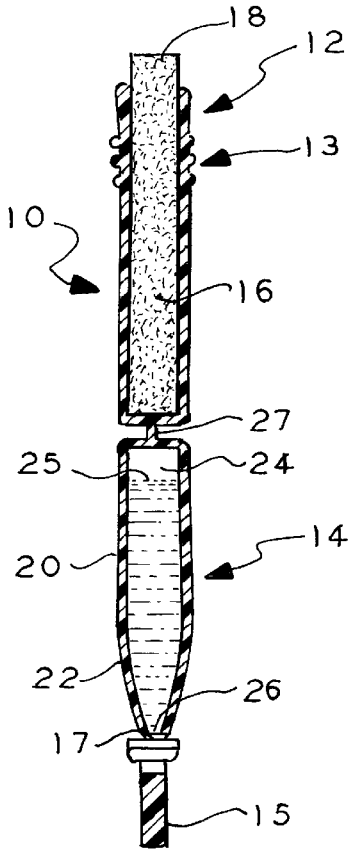
FIG. 3 is a cross-sectional view taken generally the line 3—3 in FIG. 2 in the direction of the arrows.

Referring to FIGS. 1–3, an embodiment of the dual chamber apparatus of the present invention is shown and indicated by general numerical designation 10. Apparatus

10, by way of example, is embodied in these FIGS. as dual chamber spot remover apparatus or spot remover apparatus. The apparatus 10, note in particular FIG. 3, is comprised of a body of material including an upper portion indicated by general numerical designation 12, a lower portion indicated by general numerical designation 14, and a twist-off cap 15 connected to the body portion by a frangible web 17 (FIG. 2) of reduced thickness. It will be understood that the terms upper, lower, and inner and outer as used herein are merely relative terms used to describe elements of the inventions in their positions as shown in the respective drawings. The upper portion 12 comprises a hollow generally cylindrical portion providing a generally cylindrical hollow chanter 16 in which a generally cylindrical body of absorbent material 18 resides in a slight interference fit and with a portion of the absorbent material 18 extending out of the chamber 16.

The lower portion 14 includes an inner hollow generally cylindrical portion 20 and an outer generally truncated conical portion 22 combining to provide a chamber 24 in which a body of liquid spot remover 25 resides or is sealingly contained, the liquid spot remover 25 is of the type known to the art for removing spots of the types noted above. From FIGS. 3 and 4 it will be understood that the outer truncated conical portion 25 terminates in a liquid discharge opening 26 (illustrated diagrammatically) and that the twist-off cap or tab 15 is connected to the apex portion of the truncated conical portion 22 by a frangible web 17 (illustrated diagrammatically) of reduced thickness. Referring again to FIG. 3, it will be understood that the body of material providing the apparatus 10 includes a solid portion 27 physically separating the chambers and preventing contact within the apparatus of the liquid spot remover 25 and the cylinder of absorbent material 18.

Figure 4:
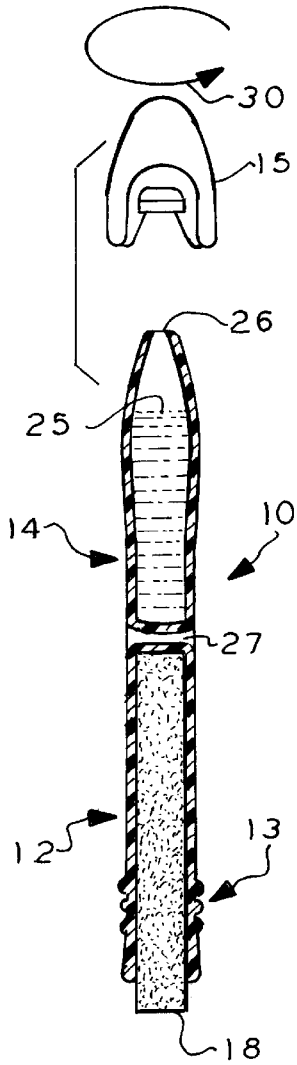
FIG. 4 is an inverted view of the cross-section of FIG. 3 and showing the twist-off cap removed.

For use, and referring to FIG. 4, the apparatus 10 is inverted, the twist-off cap 15 is twisted off of the apparatus 10, as indicated by the circular arrow 30, after which, the liquid discharge opening 26 is placed over a spot, of the types noted above, and the portion 14 of the apparatus is squeezed or compressed such as by the thumb and index of a person, to discharge the liquid spot remover 25 onto the spot. As known in the art, the spot remover 25 performs a spot removing function, such as for example, dissolving a spot of grease, after which the apparatus 10 is inverted and the portion of the cylinder of absorbent material 18 extending out of the chamber 16 is placed into engagement with the discharged liquid spot remover and dissolved grease for example, whereupon the liquid spot remover, and such dissolved grease are absorbed into the cylinder of absorbent material 18 by capillary attraction. The cylinder of absorbent material 18 may be of the type known to the art as being suitable for absorbing known liquid spot removers.

Referring again to FIGS. 1–4, it will be understood, that the upper body portion 12 of the dual chamber apparatus 10 may be provided with a plurality of outwardly extending annular ridges indicated by general numerical designation 13 and which ridges facilitate the holding and manipulating of the dual chamber apparatus 10 the present invention while the absorbent material 18 is absorbing the discharged liquid spot remover and, for example, a spot of dissolved grease.

Figure 5:
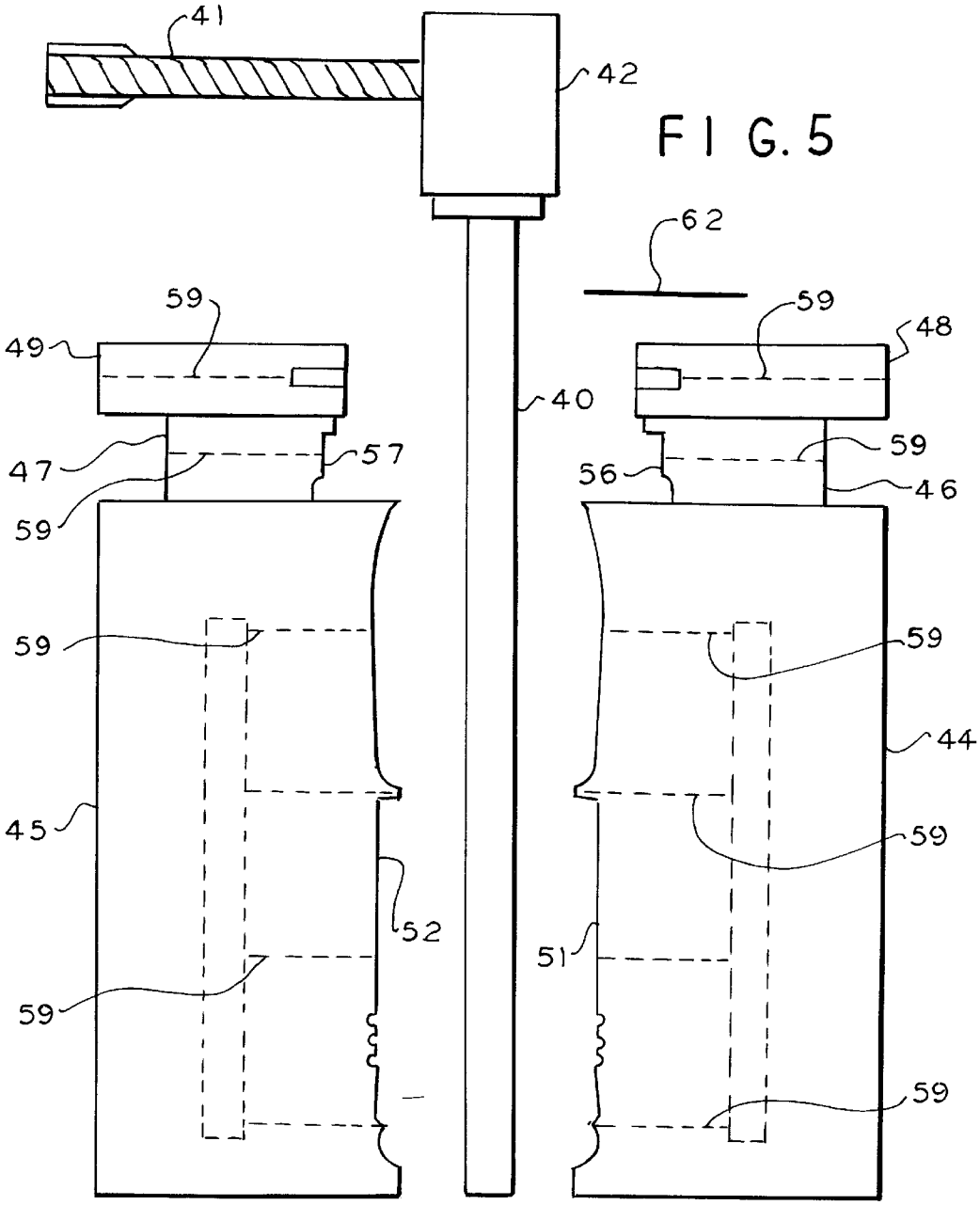
FIG. 5 is a diagrammatical illustration of a first stage of the manufacturing process of the present invention.
Figure 6:
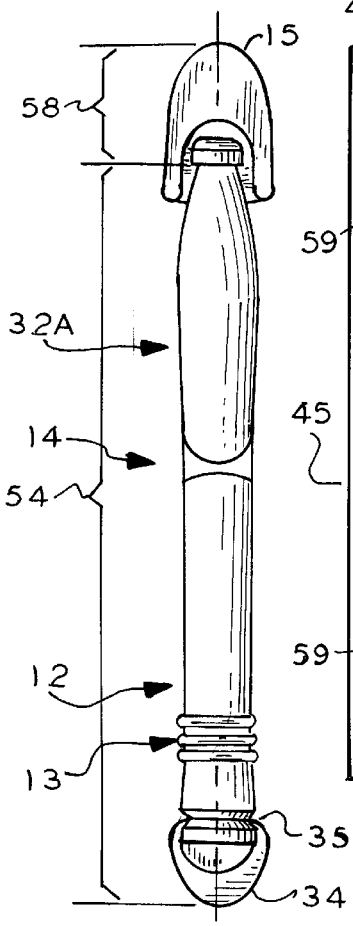
FIG. 6 is an elevational view of a pre-form produced by the manufacturing process of the present invention.

Referring now to FIGS. 5–9, the manufacturing process of the present invention, and apparatus for practicing such process, are illustrated diagrammatically. The apparatus illustrated diagrammatically in FIGS. 5, 7–9 is sometimes referred to in the art as blow-fill-seal apparatus and such apparatus is commercially available Weiler Engineering, Inc. of Elk Grove, Ill. It will be understood that the manufacturing process of the present invention produces a pre-form shown in FIG. 6 and indicated by general numerical designation 32A. The pre-form 32A shown in FIG. 6 is inverted with respect to the dual chamber apparatus 10 shown in FIG. 2 and includes the portions 12 and 14 shown in FIG. 2 and described above. In addition, the pre-form 32A includes a second twist-off cap or tab 34.

As shown in FIG. 5, in the preferred embodiment, a parison 40 of low density polyethylene is extruded from an extruder 41 and a parison head 42 downwardly between a pair of main molds 44 and 45, mounted for sliding reciprocal movement toward and away from each other, a pair of sealing molds 46 and 47, mounted for sliding reciprocal movement toward and away from each other, and a pair of holding jaws 48 and 49 mounted for sliding reciprocal movement toward and away from each other. The parison 40, as known to those skilled in the art, is a hollow or cylindrical tube of relatively molten, or semi-molten, plastic such as the above-noted low density polyethylene. The main molds 45 and 46 are provided with opposed mold cavities 51 and 52 complementary in shape to the first bracketed body portion 54 of the pre-form 32A shown in FIG. 6, and the sealing molds 46 and 47 are provided with opposed mold cavities 56 and 57 complementary in shape to the second bracketed body portion 58 of the pre-form 32A as shown in FIG. 6. As will be further understood from FIG. 5, the holding jaws 48 and 49, the sealing molds 46 and 47 and the main molds 44 and 45 are provided with vacuum lines or channels 59 for drawing vacuums for vacuum molding as described below.

Figure 7:
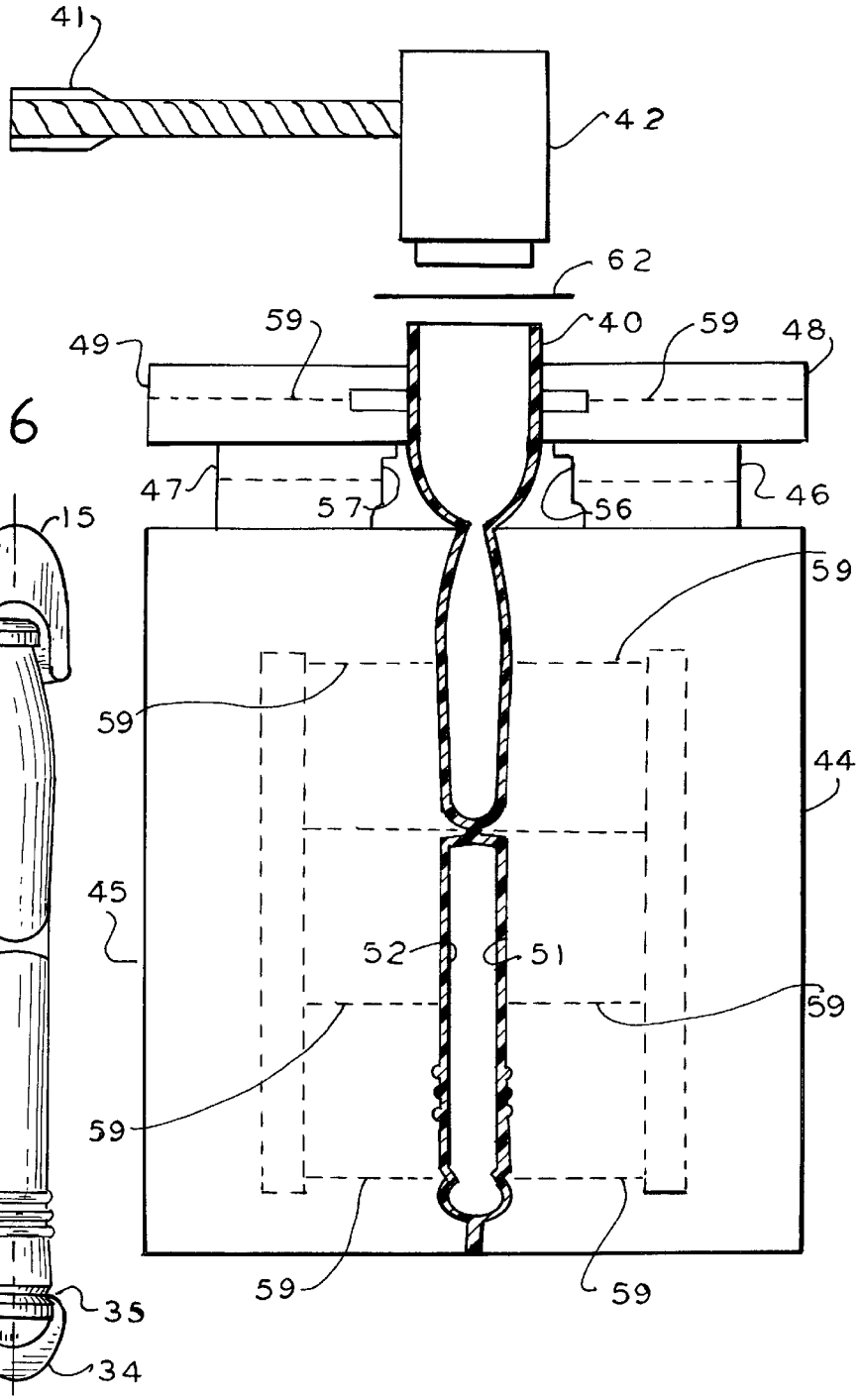
FIG. 7 is a diagrammatical illustration of the forming of the lower portion of the pre-form shown in FIG. 6.

Referring to FIG. 7, the main molds 44 and 45 are advanced into engagement with the lower portion of the parison 40 to form the first body portion 54, FIG. 6, of the pre-form 32A. It will be understood that the first body portion of the pre-form 54 includes the lower portion of the twist-off cap 15 as viewed in FIG. 5. As the main molds 44 and 45 are moved into engagement with the lower portion of the parison 40, vacuum is drawn in the vacuum channels 59 provided in the main molds to exert vacuum on the lower portion of the parison 40 to draw the lower portion of the parison firmly into engagement with the opposed mold cavities 51 and 52 formed in the main sealing molds. This manufacturing step in the manufacturing process of the present invention in addition to producing the portions 12 and 14 of the pre-form 32A and the lower portion of the twist-off cap 15 shown n FIG. 6, also produces a twist-off tab or cap 34 which is connected to the body portion 12 by a frangible web 35 illustrated diagrammatically) of reduced thickness, note FIG. 6.

As will be further understood from FIG. 7 during this step of the mnanufacturing process, the holding jaws 48 and 49 engage the upper portion of the parison 40, with vacuum being drawn in the vacuum lines or channels 59 provided in the holding jaws, to hold the upper portion of the parison 40 open and prevent it from collapsing. At this step a hot cutting knife 62 cuts the parison 40 as shown in FIG. 7.

Figure 8:
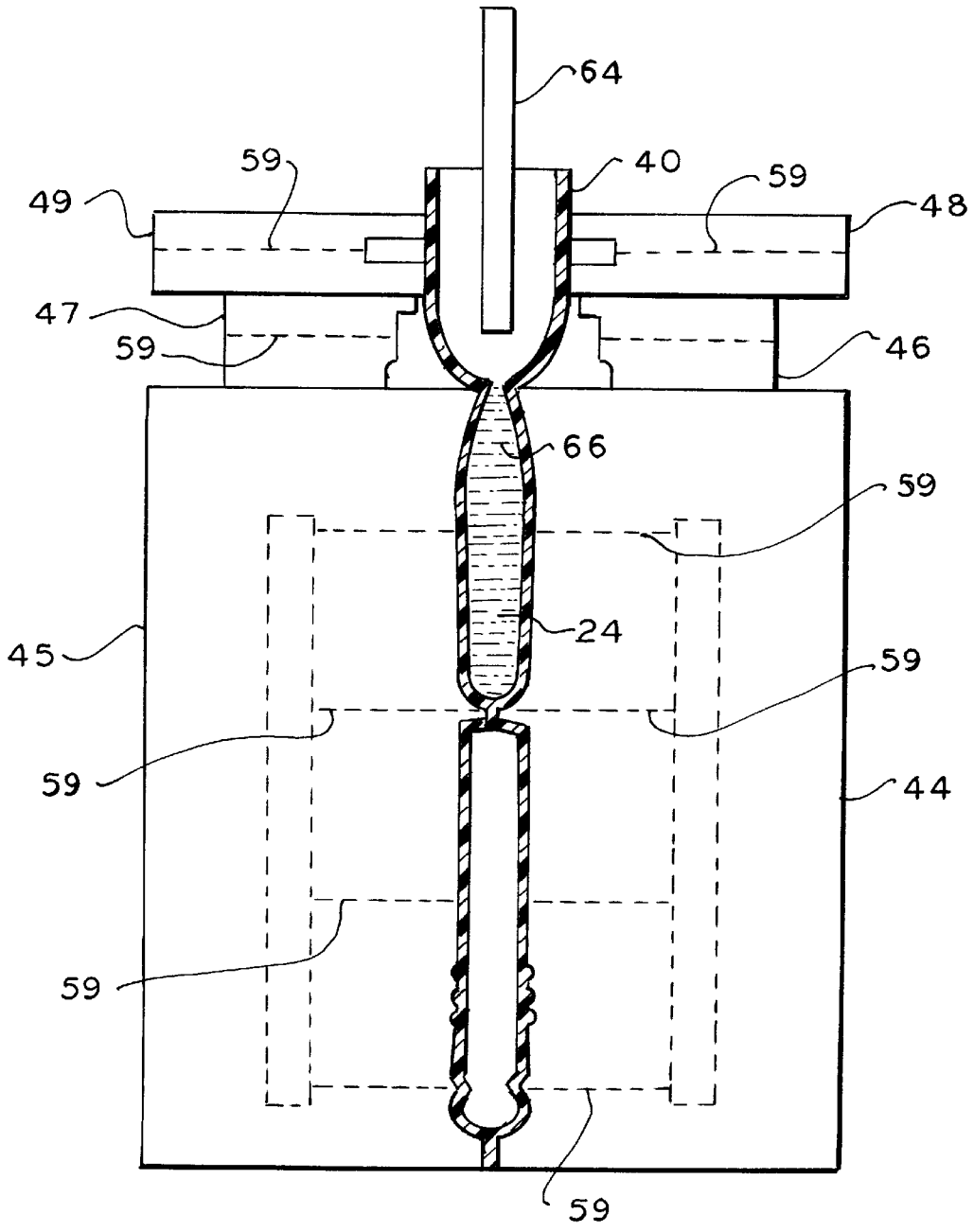
FIG. 8 is a diagrammatical illustration of the liquid filling stage of the manufacturing process of the present invention.
Figure 9:
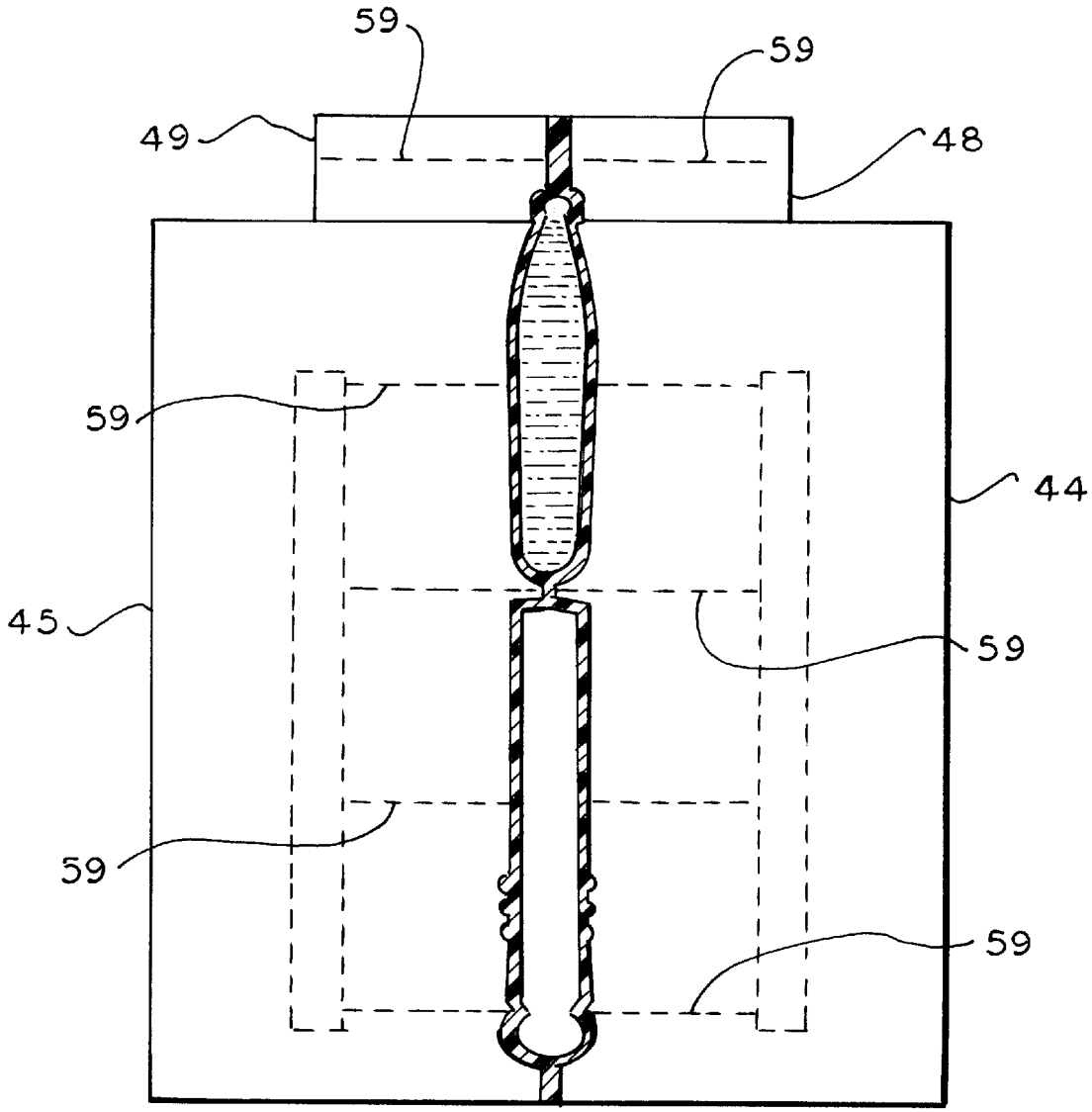
FIG. 9 is a diagrammatical illustration of the forming of the upper portion of the pre-form shown in FIG. 6.

The liquid filling step is illustrated in FIG. 8. The extruder 41 and parison head 42, shown in FIGS. 5 and 7, are indexed away and a liquid filling nozzle 64 is indexed into position and advanced into the upper portion of the parison 40 as shown in FIG. 8. In the preferred embodiment, dual chamber spot remover apparatus is formed, and hence the liquid filling nozzle 64 dispenses a body of liquid spot remover 66 into the chamber 24 as shown. Thereafter, the liquid filling nozzle 64 is indexed away and, as shown in FIG. 9, the sealing molds 48 and 49 are advanced into engagement with the upper portion of the parison 40 to form the body portion 58 of the pre-form 32A shown in FIG. 6, namely the upper portion of the twist-oft cap 15, and vacuum is drawn in the channels 59 formed in the sealing molds to exert a vacuum on the upper portion of the parison to draw the upper portion of the parison firmly into the opposed mold cavities 56 and 57 formed in the sealing molds 48 and 49. This step completes the formation of the twist-off tab 15; FIG. 6. The main molds 44 and 45 the sealing molds 48 and 49 are then opened to the positions shown in FIG. 5 and the now completely formed pre-form 32A (FIG. 6) is removed.

Figure 10:
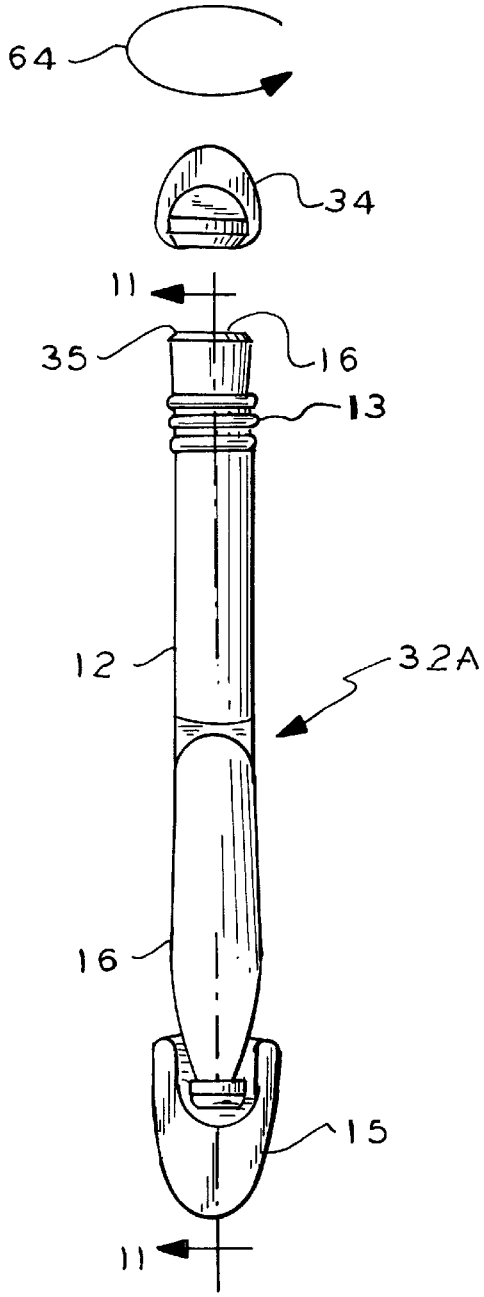
FIG. 10 is an illustration of the removing of a twist-off cap in the manufacturing process of the present invention.
Figure 11:
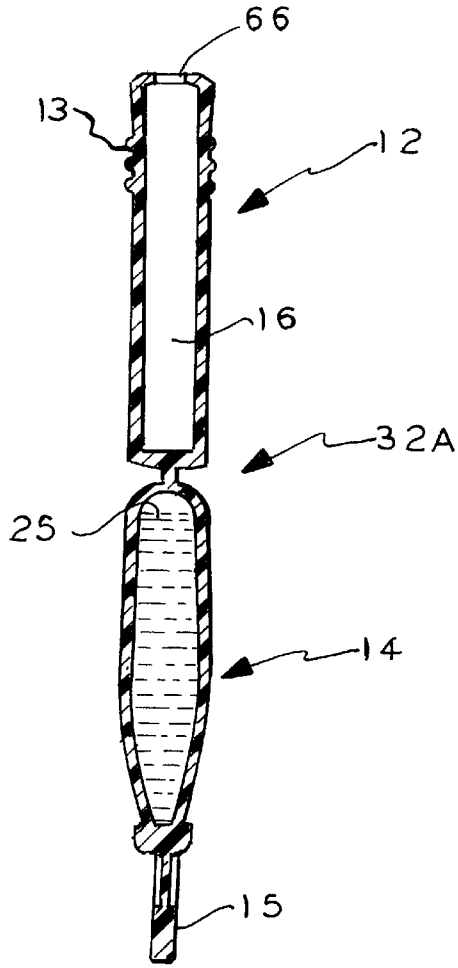
FIG. 11 is a vertical cross-sectional view taken generally along the line 11—11 in FIG. 10 in the direction of the arrows.
Figure 12:
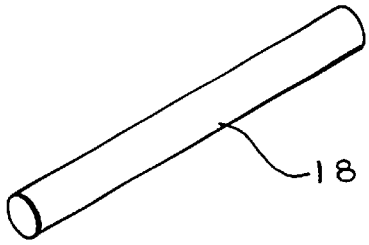
FIG. 12 is a perspective view of a body of cylindrical absorbent material.

To complete the manufacturing process of the present invention, and as illustrated in FIG. 10, the pre-form 32A is inverted from the position shown in FIG. 6 and the twist-off tab or cap 34 is twisted off of the body portion 12 along the frangible web 35, as indicated by the circular arrow 34, to expose the chamber 16. It will be understood that upon the frangible web 35 being broken away by the twisting off of the twist-off cap 34, an inwardly extending annular ridge 66 is produced. The cylindrical body of absorbent material 18, shown separately in FIG. 12, is then inserted into the chamber 16 and the inwardly extending annular ridge 66 engages the body of absorbent material 16 in a slight or light interference fit to enhance the retention of the body of absorbent material 18 in the chamber 16. It will be further understood that the length of the cylindrical body of absorbent material 18 is greater than the length of the chamber 16 whereby upon such insertion a portion of the absorbent material 18 extends out of the chanter 16 as shown in FIGS. 1–4.

It will be further understood that, in accordance with the further teachings of the present invention, and referring again to FIG. 1, the upper portion 12 of the dual chamber apparatus 10 may be flared slightly outwardly, particularly the upper portion 12A shown in FIG. 1 and that the portion 14A of the lower body portion 14 of the dual chamber apparatus 1C, FIG. 1, may bulge slightly outwardly. This bulging and flaring facilitates the holding of the dual chamber apparatus and the manipulation of the apparatus in moving the absorbent material 16 into engagement with the discharged spot remover 25 and the removed spot of the types noted above.

It will be understood that many variations and modifications may be made in the present invention without departing from the spirit and scope thereof.

What is claimed is:

1. Dual chamber apparatus, comprising:

a generally cylindrical and longitudinally extending body of plastic material including a first portion, a twist-off closure, a second portion, a body of liquid and a cylindrical body of absorbent material;

said first portion including a generally cylindrical hollow inner portion and a generally truncated conical hollow outer portion terminating in an apex portion providing a discharge orifice, said inner portion and said outer portion providing a first charter containing said body of liquid, said twist-off closure connected to said apex portion by a frangible web, said second portion providing a second chamber aligned coaxially with said first chamber and physically separated therefrom by a solid portion of said body of plastic material, said second chamber for receiving said cylindrical body of absorbent material with a portion thereof extending outwardly from said second portion, upon said twist-off closure being twisted off of said apex portion and said first portion being squeezed inwardly said body of liquid being discharged, and said body of absorbent material for engaging and absorbing said body of liquid discharged from said first portion.

2. Dual chamber spot remover apparatus, comprising:

a longitudinally extending body including a first portion and a second portion;

said first portion providing a first chamber containing liquid spot remover and a manually removable closure closing said first chamber, and said second portion providing a second chamber linearly aligned with said first chamber and a body of absorbent material residing in said second chamber and including a portion extending out of said second chamber, upon said closure being removed from said first portion and said liquid spot remover being discharged onto and removing a spot, said body of absorbent material for absorbing said liquid spot remover and spots.

3. Dual chamber spot remover apparatus, comprising:

a generally cylindrical and longitudinally extending body of plastic material including a first portion, a twist-off closure, a second portion, a body of liquid spot remover and a cylindrical body of absorbent material;

said first portion including a generally cylindrical hollow inner portion and a generally truncated conical hollow outer portion terminating in an apex portion providing a discharge orifice, said inner portion and said outer portion providing a first chamber containing said body of liquid spot remover, said twist-off closure connected to said apex portion by a frangible web, said second portion providing a second chamber aligned coaxially with said first chamber and physically separated therefrom by a solid portion of said body of plastic material, said second chamber for receiving said cylindrical body of absorbent material with a portion thereof extending outwardly from said second portion, upon said twist-off closure being twisted off of said apex portion and upon said first portion being squeezed inwardly said body of liquid spot remover being discharged onto and removing onto a spot, and said body of absorbent material for engaging and absorbing said body of liquid spot remover discharged from said first portion and said spot.

4. Spot remover apparatus comprising a cylinder of absorbent material, liquid spot remover, and a longitudinally extending generally cylindrical body including a first hollow generally cylindrical end providing a first chamber and a second end including an inner generally cylindrical portion and an outer generally truncated conical portion terminating in a liquid discharge outlet and a twist-off cap connected to said truncated conical portion at said liquid discharge outlet by a frangible web, said cylinder of absorbent material residing in said first chamber with a portion of said cylinder of absorbent material extending out of said first chamber, and said inner cylindrical portion and said outer truncated conical portion of said second end providing a second chamber in which said liquid spot remover resides, said first chamber and said second chamber being coaxially aligned and said body including a solid portion physically separating said first chamber and said second chamber.

* * * * *